US006023274A

United States Patent [19]

Griffiths

[11] Patent Number: 6,023,274

[45] Date of Patent: Feb. 8, 2000

[54] WINDOWING DISPLAY SYSTEM

[75] Inventor: Edward Griffiths, Southampton, United Kingdom

[73] Assignee: International Business Machines Corp., Armonk, N.Y.

[21] Appl. No.: 08/968,198

[22] Filed: Nov. 12, 1997

[30] Foreign Application Priority Data

Jul. 9, 1997 [GB] United Kingdom ..... 9714369

[51] Int. Cl.[7] ..... G09G 5/06

[52] U.S. Cl. ..... 345/340; 345/186; 345/199

[58] Field of Search ..... 345/509, 199, 345/510, 186, 340

[56] References Cited

U.S. PATENT DOCUMENTS

| | | | |
|---|---|---|---|
| 5,430,465 | 7/1995 | Sabella et al. | 345/199 |
| 5,629,720 | 5/1997 | Cherry et al. | 345/340 |
| 5,703,627 | 12/1997 | Young | 345/199 |

FOREIGN PATENT DOCUMENTS 0574630 12/1993 European Pat. Off. .

*Primary Examiner*—Raymond J. Bayerl
*Assistant Examiner*—Cuong T. Thai
*Attorney, Agent, or Firm*—A. Bruce Clay

[57] ABSTRACT

To accommodate the fact that, not only may a window require a number of user-determined colors to display, for example, an image, the window may also need to display widgets forming a user interface within the window in distinctive user-defined colors, while still causing the minimum disturbance to other displayed windows in windowing display systems of the type having storage locations for storing a colormap which determines the colors displayed in the system corresponding to particular pixel values, and which generate a shared colormap by assigning screen colors to pixel values dynamically as the screen colors are required by tasks using the system, and allow at least some of the windows to have a private colormap which can be copied into the storage locations when the corresponding window is activated, a method of generating a private colormap for a window is disclosed characterised by: overwriting a first selected portion of the private colormap for the window with a user-determined colormap to leave a remainder of said private colormap unallocated; ascertaining a number of user-defined user interface colors required by said window; and overwriting a second selected portion of the private colormap with a portion of said shared colourmap to form a modified colormap, said portion of said shared colormap not being greater than said remainder less said number of user-defined user interface colors.

13 Claims, 2 Drawing Sheets

WINDOWING DISPLAY SYSTEM

FIELD OF THE INVENTION

The invention relates to windowing display systems and, more particularly, to the generation of colourmaps therein.

BACKGROUND OF THE INVENTION

European Patent No. 574,630 discloses a method of generating a private colourmap for a window in a windowing display system of the type having storage locations for storing a colourmap which determines the colours displayed in the system corresponding to particular pixel values, and means for generating a shared colourmap by assigning screen colours to pixel values dynamically as the screen colours are required by tasks using the system, and which system allows at least some of the windows to have a private colourmap which can be copied into the storage locations when the corresponding window is activated.

EP 574,630 discloses overwriting a selected portion of a copy of the shared colourmap with a user-determined colourmap of the same size as the selected portion to form a modified colourmap; and copying the modified colourmap into an area of storage assigned to the private colourmap for the window.

EP 574,630 does not take into account the fact that, not only may a window require a number of user-determined colours to display, for example, an image, the window may also need to display widgets, such as buttons, forming a user interface within the window in distinctive user-defined colors.

DISCLOSURE OF THE INVENTION

To accommodate this requirement while still causing the minimum disturbance to other displayed windows, the present invention provides a method of generating a private colourmap for a window in a display system, the method being characterised by the steps of:

overwriting a first selected portion of the private colourmap for the window with a user-determined colourmap to leave a remainder of said private colourmap unallocated;

ascertaining a number of user-defined user interface colours required by said window; and overwriting a second selected portion of the private colourmap with a portion of said shared colourmap to form a modified colourmap, said portion of said shared colourmap not being greater than said remainder less said number of user-defined user interface colours.

A portion of a private colourmap can thus be overwritten with a) a user-determined colourmap which can be used, for example, for image display; and b) user-defined colours which can be used for displaying the user interface. The user can range their image colours in advance to lie in the range of pixel values set by them in this colourmap and will obtain fast image display with no interference with the colours used in other windows. It will be seen, however, that the invention is not alone useful for windows displaying images, rather it can be used for any window requiring a large number of colours.

In the same manner as EP 574,630, the first selected portion is the portion of the shared colourmap which would be filled last in generation of the shared colourmap by the system. The first portion is thus selected in such a way that it is known that there is unlikely to be any overlap with the pixel values used by other tasks. For example, in a display system in which the shared colourmap is generated by assigning to a newly required colour the nearest available pixel value to one end of a range of pixel values, the selected portion can end at the other end of the range. In systems such as X-Windows which fill the shared colourmap from the bottom in this way, choosing the top portion of the colourmap for the overwrite colourmap ensures that it is unlikely that the existing window colours and the overwritten colours will overlap.

As in EP 574,630, even if there is some overlap, only a few colours in the surrounding windows will be affected when the image window is activated. However, the performance of the system according to the invention degrades less than the performance of the previous system as the size of the overwritten colourmap increases, because the user-defined user interface colours buffer the shared colourmap colours from the image colourmap colours and are generally more mutually distinctive than the colourmap used for image display. This is particularly advantageous because current applications, for example, Netscape, demand a great number of image colours which, without the present invention, could adversely affect other applications significantly.

In one embodiment of the invention this method is used only on first activation, ie creation, of a window, the same private colourmap being copied into the storage locations on subsequent activation of the window.

Viewed from another aspect, the invention provides an image processor for use with a windowing display system of the above type, characterised by logic for overwriting a first selected portion of the private colourmap for the window with a user-determined colourmap to leave a remainder of said private colourmap unallocated; ascertaining a number of user-defined user interface colours required by said window; and overwriting a second selected portion of the private colourmap with a portion of said shared colourmap to form a modified colourmap, said portion of said shared colourmap not being greater than said remainder less said number of user-defined user interface colours.

The invention also provides a windowing display system including such an image processor.

DESCRIPTION OF PREFERRED EMBODIMENT

Figure 1:
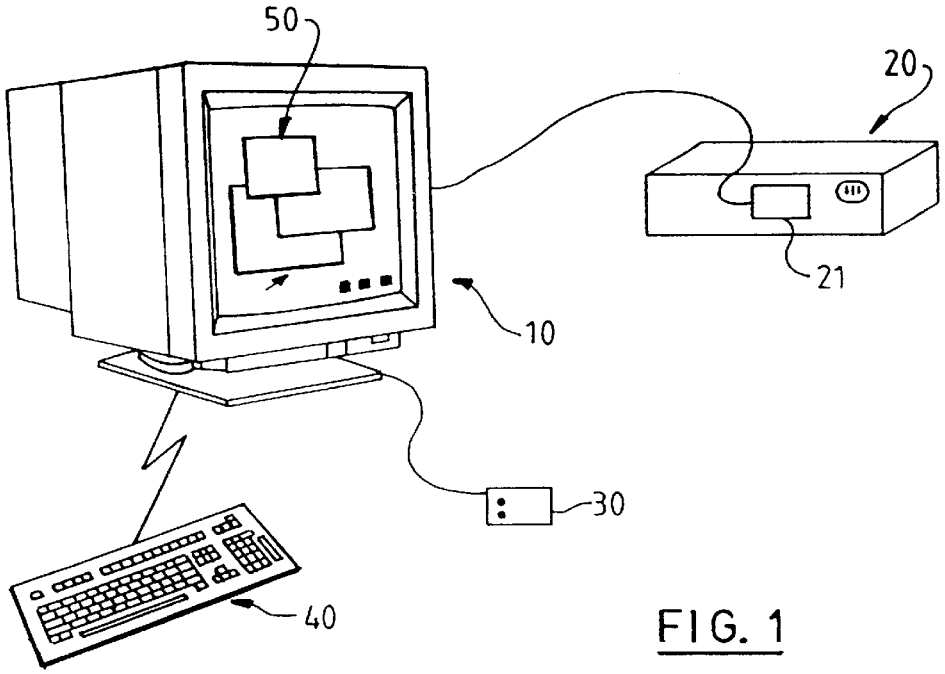
FIG. 1 shows a display system according to the invention.

Referring to FIG. 1 there is shown a windowing display system comprising display device 10, system unit 20, mouse 30 and keyboard 40. A user interacts with the system via windows 50 displayed on the display device 10. System unit 20 includes display adapter 21 in which is stored one or more hardware colourmaps which, when selected, determine the colours displayed on display device 10 corresponding to particular pixel values supplied to the display adapter by an associated application running on the system.

Figure 2:
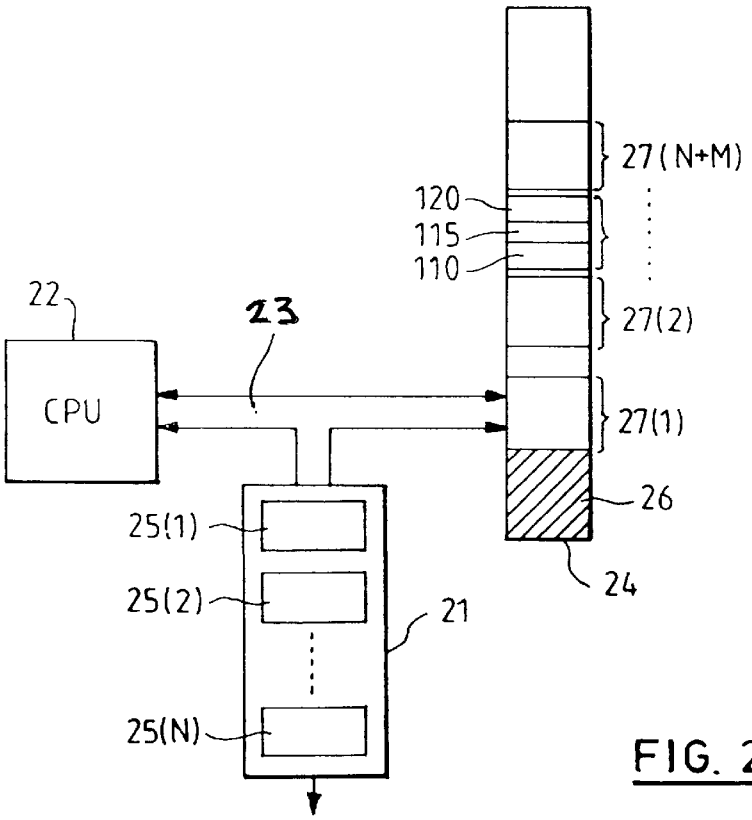
FIG. 2 is a schematic diagram showing parts of the system unit in the embodiment of the invention.

FIG. 2 is a schematic diagram showing parts of system unit 20. CPU 22 is connected via bus 23 with Random Access Memory (RAM) 24 and display adapter 21. Display adapter 21 includes storage locations 25 for storing one or more hardware colourmaps 25(1) . . . 25(n). RAM 24 has an area reserved for the shared colourmap 26 and one or more private colourmaps 27(1) . . . 27(n+m) for any associated applications running on the system requiring a private colourmap.

The system generates, in a manner well known in the art, shared colourmap 26, which can be used by a number of different applications, by assigning screen colours to pixel values dynamically in response to a request for a particular colour from an application.

Figure 3:
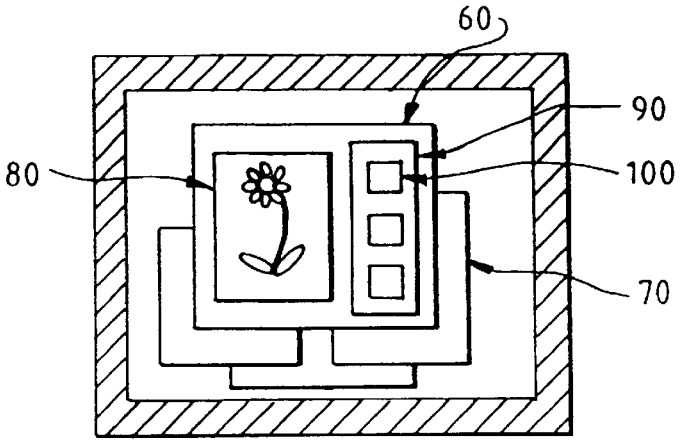
FIG. 3 shows a view of the display screen in use.

FIG. 3 shows a typical view of the display device screen in use. It shows a window 60 corresponding to one application and other windows 70 corresponding to other applications running on the system. Window 60 includes a number of other windows, image window 80 and user-interface control panel window 90 all of which are associated with the same application. Control panel window 90 includes widgets, such as, button windows 100, by means of which the user can interact with the application in a manner well known in the art. Other widgets can include title bars, pull down menus and any other user interface features.

In this embodiment, the system is set up so that a window is activated whenever the display cursor moves onto an area of the display on which the window is visible. It will be understood that there are many other ways in which activation of a window could be initiated, such as execution of an instruction in an application or by a specific action, like the pressing of a mouse button, performed by a user. Activation, as used herein, means any process which requires a colourmap corresponding to a window to be installed in a hardware colourmap.

In the system, when a window associated with an application is activated, the application can either copy a private colourmap corresponding to the window into a hardware colourmap or can elect to use the shared colourmap 26, which is common to all the windows in the system.

In conventional systems, when n hardware colourmaps 25(1) . . . 25(n) are available in a system then n windows can use the shared colourmap 26 and n−1 private colourmaps 27 to store user defined colourmaps without colour conflicts arising as the system swaps from one activated window to another.

The present invention is useful when the number of windows n+m requiring private colourmaps exceeds the number of available hardware colourmaps n. In such a case, there will be contention between windows for use of the same hardware colourmaps.

If a window is designated to use a hardware colourmap then, when another window in the system designated to use the same hardware colourmap is activated, the colours of the window will change as the colour map used by the newly activated window is copied into a hardware colourmap. If the shared colourmap 26 is used, then the application is constrained to make use of any free cells remaining in the shared colourmap or any shared colours already allocated, in either case it must make use of the colour value to pixel value mapping therein, which cannot be determined in advance.

Figure 5:
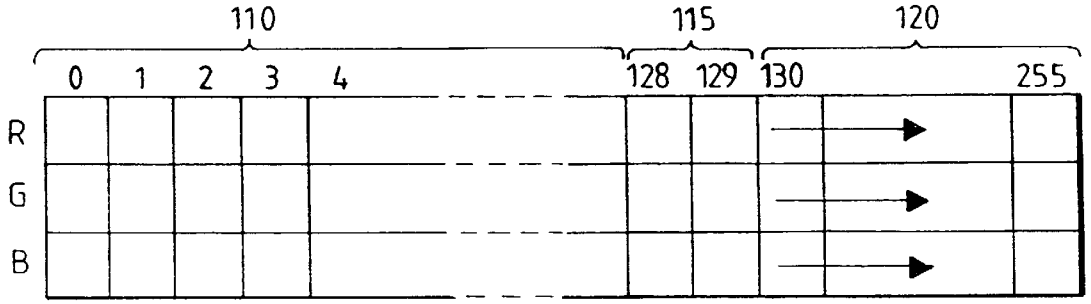
FIG. 5 is a schematic diagram showing a private colourmap generated using the method of the present invention.
Figure 4:
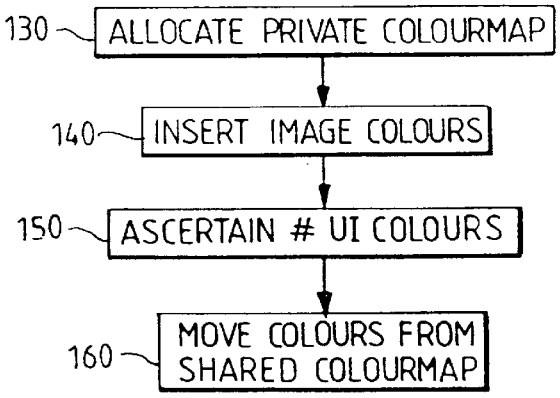
FIG. 4 is a flow diagram showing the main steps of the method of the invention.

In the present embodiment, on creation of an image window, such as window 80, the steps shown in FIG. 4 are performed under program control by the CPU 22. A private colourmap is allocated at step 130. The private colourmap is then overwritten beginning at step 140 as shown in FIG. 5. The upper part 120 of the map is overwritten by a user-determined colourmap for use in displaying, for example, an image 80. For example, in this embodiment, which uses 1 byte/pixel windows and 256-entry colourmaps, the upper part 120 can stretch from pixel values 130 to 255. The program controlling the window at step 150 then needs to ascertain a number of user-defined user interface colours required by said window. These are, for example, the colours to be used for the background of the window 90 and the buttons 100. These colours are allocated to pixel values in a part 115 of the map below the upper part 120. In the example, these colours are allocated pixel values 128 and 129. At step 160, the lower part of the map 110 is copied from the corresponding portion of the shared colourmap and thus includes the pixel values which have been assigned to colours by the system. In the example, the lower part stretches from pixel values 0 to 127. The private colourmap 27 is then copied into a selected one of the hardware colourmaps 25(1) . . . 25(n) in display adapter 21 whenever the window is activated.

A problem with European Patent no. 574,630 was that it did not cover how an application should use a private colormap so that recoding was minimised. In European patent no. 574,630, it was also envisaged that the entire private colormap would be taken up with either colorcells required for image display or copied from the shared colormap.

In the present embodiment, an application needs only minimal recoding to use a private colormap. This private colormap contains a copy of the shared colormap from the bottom up, but leaves unallocated the number of colorcells the application will require. While the application may allocate some of these cells for display of images still other colorcells 115 are left unallocated. In X-windows, for example, these unallocated cells will be filled when the unaltered application code either directly (e.g. by using XAllocNamedColor etc) or indirectly (via the Xt resource file/widget mechanism) allocates colours.

Generally an X Windows application will either specifically allocate colours via calls such as XAllocNamedColor or the XToolkit will allocate colours on behalf of the application for colours specified by other means (e.g. in an application resource file). These colours are usually allocated as shared colorcells and as such their position in the colormap cannot be controlled. It is from the unallocated cells that these colours will be allocated. This will avoid the need for any change to the existing application code apart from an initial call directly after Toolkit initialisation (eg by calling XtAppinitialize) to allocate a private colormap and insert some of the default colormap.

It will be understood, of course, that the term user as used herein can include the application using the display system and the programmer of such an application.

In this embodiment of the invention the modified private colourmap is only generated when the image window is created, ie when the window is first activated, the same modified private colourmap being copied into the hardware colourmap on subsequent activation of the window. However, it will be understood that the system could equally be arranged to execute all the above steps every time the window is activated or each time the shared colourmap is changed by another task so that the private colourmap is kept up to date.

Colour value assignments in the lower part of the hardware colourmap will be common to other applications running on the system which are using the shared colourmap and colours in the upper part of the hardware colourmap will be assigned to pixel values in a predetermined way for use by the application.

Figure 6:
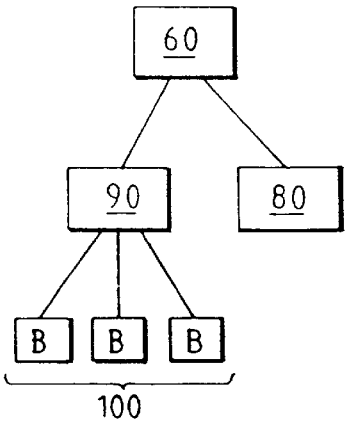
FIG. 6 is a diagram illustrating a window hierarchy.

As is common in windowing display systems, the windows are arranged in a hierarchy as shown in FIG. 6. Image window 80 and control panel window 90 are children of the window 60. Button windows 100 are children of control panel window 90. Window 60 itself is a child of the root window, which is the top window in the display system.

In this case, a single image processing application controls window 60 and all its children. The private colourmap is associated with window 60 causing it to be used whenever window 60 or any of its children are activated. This ensures that no colours are changed on the screen whenever the cursor moves between windows 60, 80, 90 or 100. If the cursor moves outside of window 60 only the colours of the window 60 and its children will change.

In this embodiment of the invention the method is carried out using an appropriate computer program running on a general purpose graphics workstation. The program takes the form of a function which is part of a software library of routines designed to interface application programs to such a workstation. In this particular example it is designed for use as part of a client program to interface with the X-Windows server program, which provides all the function necessary to generate the screen image, including management of the windows and the colourmaps, on the display device. A standard X-windows style interface is provided which allows each application to specify a colourmap of any length up to the length of the X-Windows colourmap and also to specify where that colourmap should be placed in the private copy of the X-Windows shared colourmap.

Whilst for the purposes of clarity in this embodiment the client program and the server program have been described running on a single graphics workstation, it will be understood that the client program does not necessarily have to run on the same workstation as the X-windows server program. The server program can run on a graphics workstation on which the screen images are actually displayed, whilst the client can run on another computer which is connected to the graphics workstation via an appropriate data communications network.

It should further be noted that the invention could be implemented in hardware, for example as a hardware feature of such a workstation, or indeed could be implemented as any combination of hardware and software.

I claim:

1. A method of generating a private colourmap for a window in a windowing display system of the type having storage locations (25) for storing a colourmap which determines the colours displayed in the system corresponding to particular pixel values, and means for generating a shared colourmap (26) by assigning screen colours to pixel values dynamically as the screen colours are required by tasks using the system, and which system allows at least some of the windows to have a private colourmap (27) which can be copied into the storage locations (25) when the corresponding window is activated, the method being characterised by the steps of:

overwriting (140) a first selected portion of the private colourmap for the window with a user-determined colourmap to leave a remainder of said private colourmap unallocated;

ascertaining (150) a number of user-defined user interface colours required by said window; and overwriting (160) a second selected portion of the private colourmap with a portion of said shared colourmap to form a modified colourmap, said portion of said shared colourmap not being greater than said remainder less said number of user-defined user interface colours.

2. A method as claimed in claim 1 in which the first selected portion (120) is the portion of the shared colourmap which would be filled last in generation of the shared colourmap by the system.

3. A method as claimed in claim 1 for a display system in which the shared colourmap is generated by assigning to a newly required colour the nearest available pixel value to one end of a range of pixel values, wherein the first selected portion (120) ends at the other end of the range.

4. A method as claimed in claim 1 wherein the size of the user-determined colourmap is a substantial proportion of the size of the shared colourmap.

5. A method of activating a window in a windowing display system, the method comprising generating a private colourmap for the window using a method as claimed in claim 1 and copying the generated private colourmap into the storage locations (25).

6. A method of creating a window in a windowing display system, the method including activating the window using a method as claimed in claim 5.

7. A method of operating a windowing display system, the method comprising creating a window using a method as claimed in claim 6 and copying the generated private colourmap into the storage locations each time the window is subsequently activated.

8. A method of operating a windowing display system, the method comprising generating a private colourmap for at least one window in the system using a method as claimed in claim 1 each time the shared colourmap is changed.

9. A method according to claim 1 in which said storage locations include a plurality of hardware colourmaps and the number of windows having private colourmaps exceeds the number of hardware colourmaps, the method including the step of copying the respective private colourmaps for more than one of said windows when activated into a predetermined one of said hardware colourmaps.

10. A method according to claim 1 in which said storage locations include one hardware colourmap and a plurality of windows having private colourmaps are displayed in the system, the method including the step of copying the respective private colourmaps for said windows when activated into said hardware colourmap.

11. A method according to claim 1 further including the step of allocating in the private colourmap the user-defined user interface colours required by said window.

12. An image processor for use with a windowing display system of the type having storage locations (25) for storing a colourmap which determines the colours displayed in the system corresponding to particular pixel values, and means for generating a shared colourmap by assigning screen colours to pixel values dynamically as the screen colours are required by tasks using the system, and which system allows at least some of the windows to have a private colourmap which is copied into the storage locations (25) when the corresponding window is activated in the display system, the image processor comprising logic for assigning an area of storage in a storage device to a window in the display system, and characterised by logic for overwriting a first selected portion of the private colourmap for the window with a user-determined colourmap to leave a remainder of said private colourmap unallocated; ascertaining a number of user-defined user interface colours required by said window; and overwriting a second selected portion of the private colourmap with a portion of said shared colourmap to form a modified colourmap, said portion of said shared colourmap not being greater than said remainder less said number of user-defined user interface colours.

13. A windowing display system including an image processor as claimed in claim 12.

* * * * *